US009010098B2

(12) United States Patent
Ganesan et al.

(10) Patent No.: US 9,010,098 B2
(45) Date of Patent: Apr. 21, 2015

(54) AFTER-TREATMENT DEVICE

(71) Applicant: Electro-Motive Diesel, Inc., LaGrange, IL (US)

(72) Inventors: Pradeep Ganesan, Chicago, IL (US); Satyajit Gowda, Bangalore (IN)

(73) Assignee: Electro-Motive Diesel, Inc., LaGrange, IL (US)

( * ) Notice: Subject to any disclaimer, the term of this patent is extended or adjusted under 35 U.S.C. 154(b) by 280 days.

(21) Appl. No.: 13/658,939

(22) Filed: Oct. 24, 2012

(65) Prior Publication Data

US 2014/0109558 A1 Apr. 24, 2014

(51) Int. Cl.

| | |
|---|---|
| ***F01N 3/02*** | (2006.01) |
| ***B01D 46/00*** | (2006.01) |
| ***B01D 59/50*** | (2006.01) |
| ***B61C 5/00*** | (2006.01) |
| ***F01N 13/00*** | (2010.01) |

(52) U.S. Cl.

CPC ..... *F01N 13/0093* (2014.06); *F01N 13/0097* (2014.06); *F01N 13/011* (2014.06); *F01N 2260/14* (2013.01); *F01N 2590/08* (2013.01)

(58) Field of Classification Search

CPC ..... F01N 3/021; F01N 3/0211; F01N 3/022

USPC ..... 60/295, 297, 302, 305, 311, 323, 324; 55/342, 350.1, 484, DIG. 30; 105/62.1; 95/273, 286

See application file for complete search history.

(56) References Cited

U.S. PATENT DOCUMENTS

| | | | | | |
|---|---|---|---|---|---|
| 4,709,549 | A * | 12/1987 | Lepperhoff | ..... | 60/295 |
| 4,887,427 | A * | 12/1989 | Shinzawa et al. | ..... | 60/286 |
| 4,894,074 | A * | 1/1990 | Mizrah et al. | ..... | 55/482 |
| 4,913,712 | A * | 4/1990 | Gabathuler et al. | ..... | 55/482 |
| 4,924,570 | A * | 5/1990 | Mizrah et al. | ..... | 29/896.62 |
| 5,092,913 | A * | 3/1992 | Yen | ..... | 95/286 |
| 5,571,298 | A * | 11/1996 | Buck | ..... | 55/282.3 |
| 5,582,002 | A * | 12/1996 | Pattas | ..... | 60/274 |
| 5,930,995 | A * | 8/1999 | Watanabe et al. | ..... | 60/311 |
| 5,941,066 | A * | 8/1999 | Araki et al. | ..... | 60/280 |
| 6,090,173 | A * | 7/2000 | Johnson et al. | ..... | 55/302 |
| 6,488,746 | B1 * | 12/2002 | Kosmider et al. | ..... | 95/273 |
| 6,641,646 | B2 * | 11/2003 | Rosenberg | ..... | 95/280 |
| 7,260,927 | B2 * | 8/2007 | Hsu | ..... | 60/288 |
| 7,314,501 | B2 * | 1/2008 | Fayard | ..... | 95/14 |

(Continued)

FOREIGN PATENT DOCUMENTS

| | | | | |
|---|---|---|---|---|
| DE | 4446855 A1 * | 6/1995 | ..... | F01N 3/02 |
| WO | WO 2011/087819 | 7/2011 | | |

*Primary Examiner* — Thomas Denion
*Assistant Examiner* — Mickey France
(74) *Attorney, Agent, or Firm* — Finnegan, Henderson, Farabow, Garrett & Dunner, LLP

(57) ABSTRACT

The present disclosure is directed to an after-treatment device. The after-treatment device may have a center plenum configured to be fluidly connected to an engine. The after-treatment device may also have a filter bank having a plurality of filter assemblies. Each filter assembly may have an inlet fluidly connected to the center plenum. The inlet may be oriented orthogonal to the center plenum. Each filter assembly may also have an outlet. Further, the after-treatment device may have an exhaust plenum fluidly connected to the outlet. The exhaust plenum may be oriented orthogonal to the outlet. The exhaust plenum may also have an outer wall disposed parallel to and located at a predetermined distance from the outlet.

17 Claims, 3 Drawing Sheets

(56) References Cited

U.S. PATENT DOCUMENTS

| | | | | |
|---|---|---|---|---|
| 7,582,267 | B1 | 9/2009 | Klein et al. | |
| 7,650,748 | B2 * | 1/2010 | Lavy et al. | 60/295 |
| 7,925,431 | B2 * | 4/2011 | Gallagher et al. | 701/516 |
| 7,997,071 | B2 | 8/2011 | Blaisdell | |
| 8,240,138 | B2 * | 8/2012 | Lu et al. | 60/297 |
| 2005/0000211 | A1 * | 1/2005 | Fayard | 60/295 |
| 2005/0066651 | A1 * | 3/2005 | Hsu | 60/277 |
| 2010/0187383 | A1 | 7/2010 | Olsen et al. | |
| 2011/0167810 | A1 | 7/2011 | Lebas et al. | |
| 2011/0225938 | A1 * | 9/2011 | Furumoto | 55/350.1 |
| 2011/0239644 | A1 | 10/2011 | Bennet et al. | |
| 2012/0151916 | A1 * | 6/2012 | Tiwari et al. | 60/605.1 |
| 2013/0256212 | A1 * | 10/2013 | Ben-Horin et al. | 210/323.1 |
| 2013/0256213 | A1 * | 10/2013 | Ben-Horin et al. | 210/345 |

* cited by examiner

AFTER-TREATMENT DEVICE

TECHNICAL FIELD

The present disclosure relates generally to an after-treatment device and, more particularly, to an after-treatment device with reduced back pressure.

BACKGROUND

Internal combustion engines generate exhaust as a by-product of fuel combustion within the engines. Engine exhaust contains, among other things, unburnt fuel, particulate matter such as soot, and harmful gases such as carbon monoxide or nitrous oxide. To comply with regulatory emissions control requirements, engine exhaust must be cleaned before it is discharged into the atmosphere.

Engines typically include an after-treatment device that removes or reduces harmful gases and particulate matter in the exhaust. The after-treatment device contains components such as oxidation catalysts and soot filters to help clean the exhaust gases. The presence of these components, however, can create increased resistance to the flow of exhaust (back pressure) from the engine through the exhaust system. Space constraints in engine applications can further compound these back pressure problems because the exhaust flow may have to encounter sharp turns as it passes through the after-treatment device. The geometry and size of exhaust flow passageways, and the location and arrangement of the catalysts and filters in the after-treatment systems can significantly influence back pressure.

An exemplary after-treatment system is disclosed in World Intellectual Property Organization International Publication No. WO 2011/087819 of Kiran et al. that was published on Jul. 21, 2011 ("the '819 publication"). Specifically, the '819 publication discloses a transition section for turning the flow exiting a turbocharger into three inputs of the after-treatment system. The '819 publication also discloses using restriction plates with openings having different apertures to control the amount of exhaust entering each of the three after-treatment system legs.

Although the system of the '819 publication may be adequate for situations with a relatively small number of after-treatment legs, it may not be suitable for engine applications with a large number of after-treatment components necessary to comply with modern emissions control requirements. Further, space constraints in certain engine applications may make it difficult to include an additional transition section for turning the flow as disclosed in the '819 publication. Moreover, although using openings of different sizes may help to distribute flow into different after-treatment legs, these restriction plates may also add resistance to the flow of exhaust. Notably, the '819 publication focuses on distributing the flow uniformly to more than one after-treatment leg but does not disclose a way to reduce back pressure in the after-treatment system.

The after-treatment device of the present disclosure solves one or more of the problems set forth above and/or other problems in the art.

SUMMARY

In one aspect, the present disclosure is directed to an after-treatment device. The after-treatment device may include a center plenum configured to be fluidly connected to an engine. The after-treatment device may also include a filter bank having a plurality of filter assemblies. Each filter assembly may include an inlet fluidly connected to the center plenum. The inlet may be oriented orthogonal to the center plenum. Each filter assembly may also include an outlet. Further, the after-treatment device may include an exhaust plenum fluidly connected to the outlet. The exhaust plenum may be oriented orthogonal to the outlet. The exhaust plenum may also have an outer wall disposed parallel to and located at a predetermined distance from the outlet.

In another aspect, the present disclosure is directed to a machine. The machine may include an engine having a plurality of cylinders. The machine may further include a center plenum configured to receive exhaust from the plurality of cylinders. The machine may also include a first filter bank oriented orthogonal to the center plenum and configured to receive a first portion of exhaust from the center plenum. The machine may also include a second filter bank oriented orthogonal to the center plenum and configured to receive a second portion of exhaust from the center plenum. In addition, the machine may include a first exhaust plenum oriented orthogonal to the first filter bank and configured to receive the first portion of exhaust from the first filter bank. The first exhaust plenum may include a first outer wall disposed parallel to and located at a predetermined distance from an outlet of first filter bank. The machine may also include a second exhaust plenum oriented orthogonal to the second filter bank and configured to receive the second portion of exhaust from the second filter bank. The second exhaust plenum may include a second outer wall disposed parallel to and located at the predetermined distance from an outlet of second filter bank.

DETAILED DESCRIPTION

Figure 1:
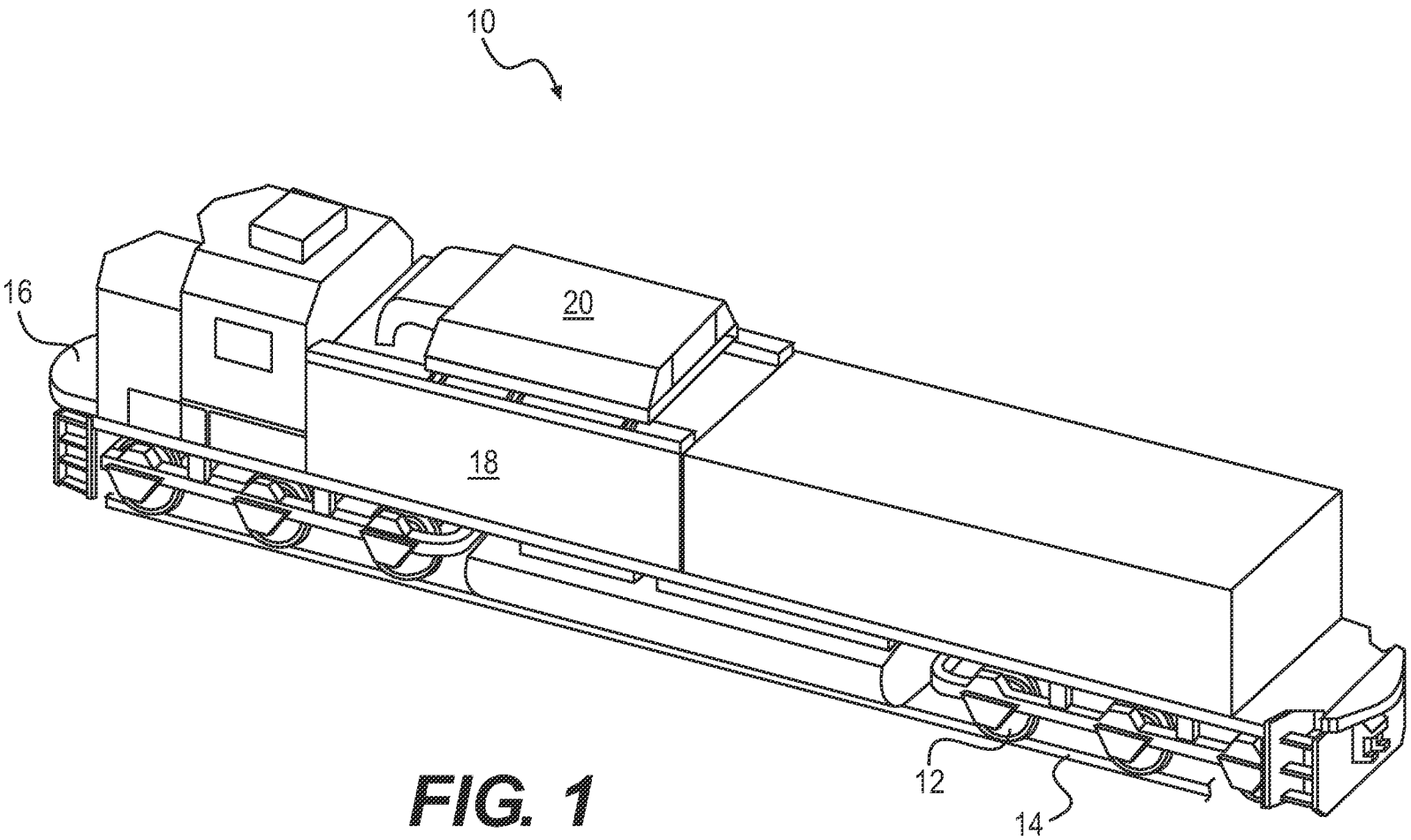
FIG. 1 is a pictorial illustration of an exemplary disclosed machine.

FIG. 1 illustrates a machine 10 with an exemplary embodiment of an after-treatment device 20 mounted on machine 10. Machine 10 may be a mobile machine that performs some type of operation associated with an industry such as transportation, marine, mining, construction, farming, power generation, or any other industry known in the art. For example, machine 10 may be a locomotive designed to pull rolling stock. Machine 10 may have a plurality of wheels 12 configured to engage a track 14, a base platform 16 supported by wheels 12, and an engine 18 mounted to base platform 16 and configured to drive wheels 12. In the exemplary embodiment shown in FIG. 1, engine 18 may be lengthwise aligned on base platform 16 along a travel direction of machine 10. Although only one engine 18 is shown in FIG. 1, it is contemplated that any number of additional engines may be included within machine 10 and operated to produce power that may be transferred to one or more traction motors (not shown) used to drive wheels 12.

Engine 18 may be any type of engine such as, for example, a diesel engine, a gasoline engine, or a gaseous-fuel-powered engine. Engine 18 may include an engine block that at least partially defines a plurality of cylinders (not shown). The plurality of cylinders in engine 18 may be disposed in an "in-line" configuration, a "V" configuration, or in any other suitable configuration. Engine 18 may be fluidly connected to after-treatment device 20 to allow exhaust generated in the plurality of cylinders to be cleaned by after-treatment device 20.

Figure 2:
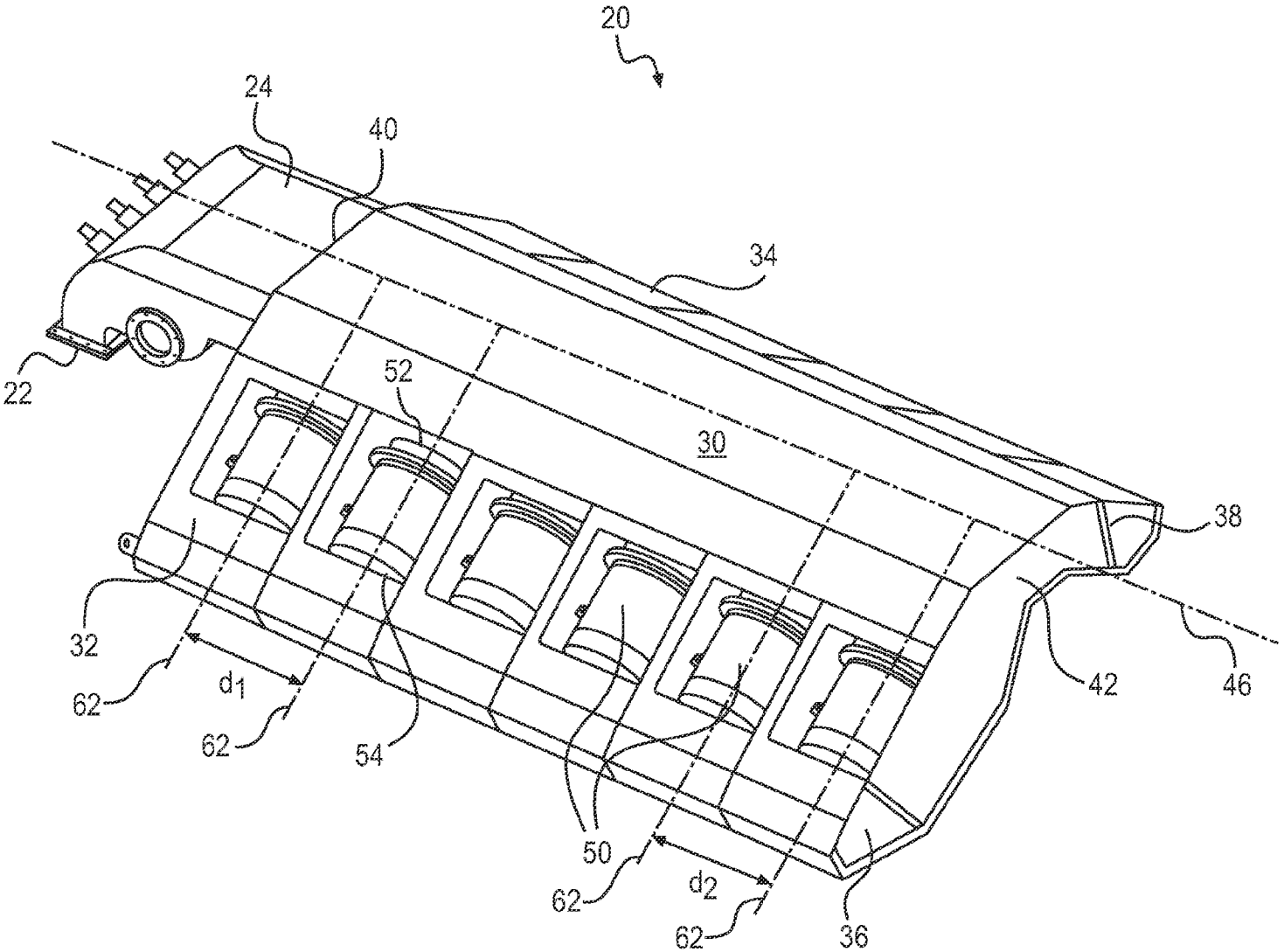
FIG. 2 is a pictorial illustrations of an exemplary disclosed after-treatment device for the machine of FIG. 1.

After-treatment device 20 may include multiple fluid paths that direct exhaust from engine 18 to the atmosphere. For example, as illustrated in FIG. 2, after-treatment device 20 may be fluidly connected via an inlet 22 to engine 18. Exhaust from engine 18 may enter after-treatment device 20 through inlet 22. Exhaust may also pass through a diffuser 24 before entering center plenum 30 of after-treatment device 20. After-treatment device 20 may also include a first filter bank 32 and a second filter bank 34. A first portion of the exhaust from center plenum 30 may enter first filter bank 32. A second portion of the exhaust from center plenum 30 may enter second filter bank 34. A first exhaust plenum 36 may be fluidly connected to first filter bank 32 to receive the portion of the exhaust and discharge it into the atmosphere. Similarly, a second exhaust plenum 38 may be fluidly connected to the second filter bank 34 to receive the remaining portion of the exhaust and discharge it into the atmosphere.

Center plenum 30 may have a first end 40 fluidly connected to diffuser 24 and a second end 42, which may be closed. Center plenum 30 may also have a longitudinal axis 46. Center plenum 30 may include additional devices, for example, fins, vanes, perforated plates etc. to help direct exhaust flow from center plenum 30 into first and second filter banks 32, 34. Further, as exhaust flow in center plenum 30 approaches closed second end 42, the exhaust flow may slow down causing an increase in the pressure adjacent second end 42. The increased pressure adjacent second end 42 may further help direct exhaust flow from center plenum 30 into first and second filter banks 32, 34.

Each of the first and second filter banks 32, 34 may include one or more filter assemblies 50 arranged to receive exhaust from center plenum 30 and discharge the exhaust into first and second exhaust plenums 36, 38, respectively. Each filter assembly 50 may include a diesel oxidation catalyst (DOC) and a diesel particulate filter (DPF). Soot particles may be removed by the DPF as exhaust flows through filter assembly 50. In addition, unburnt hydrocarbons may be oxidized by the DOC as exhaust flows through filter assembly 50.

Each filter assembly 50 may have an inlet 52 fluidly connected to center plenum 30 to receive an exhaust flow. Inlet 52 may be oriented orthogonal to center plenum 30. Each filter assembly may also have an outlet 54 fluidly connected to the first or second exhaust plenums 36, 38. Inlet 52 and outlet 54 of each filter assembly 50 may be circular. It is contemplated, however, that inlet 52 and outlet 54 may have any other appropriate cross-sectional shape known in the art. First and second exhaust plenums 36, 38 may be oriented such that exhaust flow in first and second exhaust plenums 36, 38 may be orthogonal to a direction of exhaust flow through each filter assembly 50.

Figure 3:
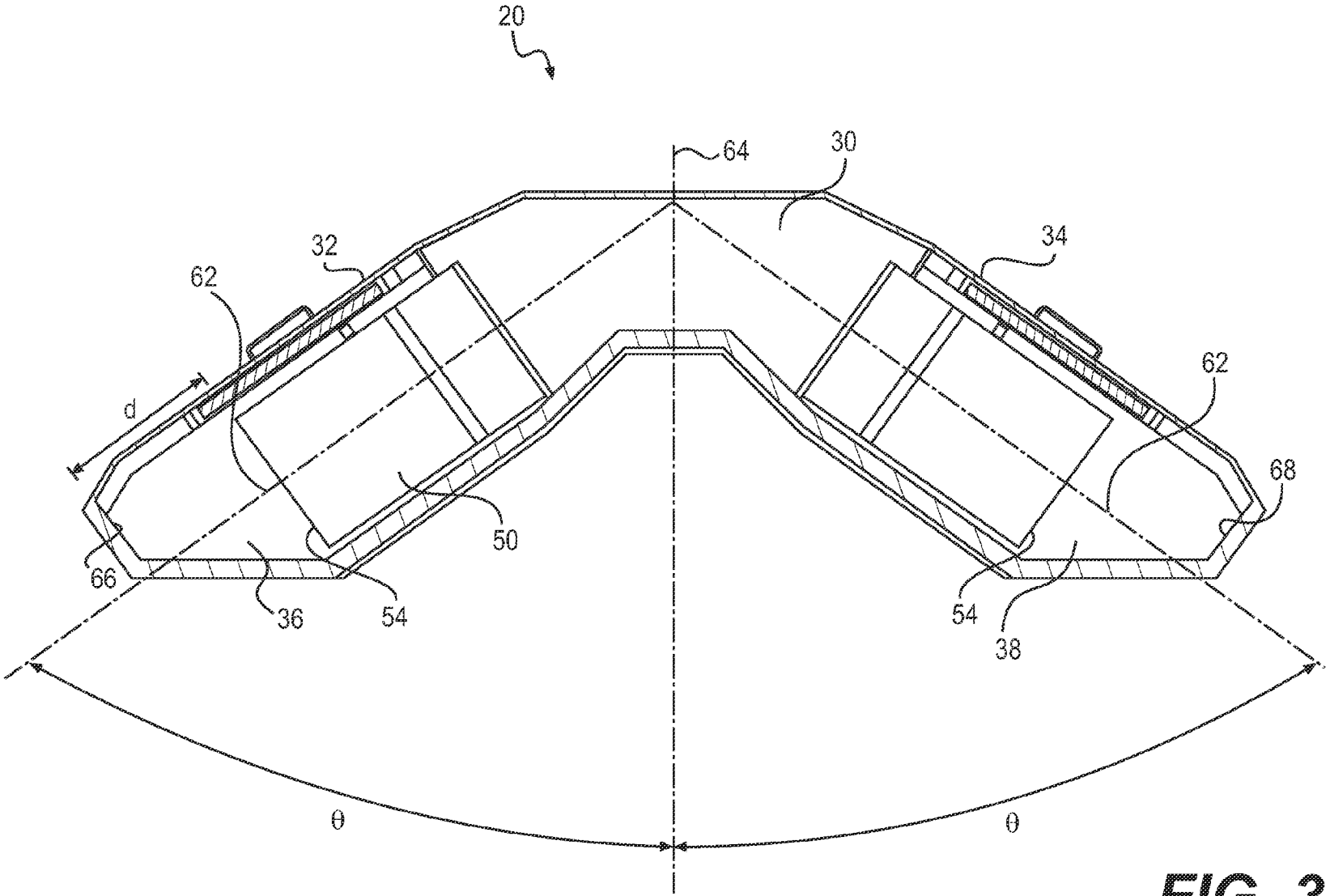
FIG. 3 is a vertical cross-section of the exemplary disclosed after-treatment device of FIG. 2.

Each filter assembly 50 may have a filter axis 62. Each filter assembly 50 may be oriented so that filter axis 62 is orthogonal to longitudinal axis 46. As further illustrated in FIG. 3, each filter assembly 50 may also be oriented so that filter axis 62 makes an angle θ relative to a vertical axis 64 of after-treatment device 20. It is contemplated that angle θ may be the same or different for each filter assembly 50. In one exemplary embodiment, angle θ may range from about 45° to 60°. As shown in FIG. 3, center plenum 30, first and second filter banks 32, 34, and first and second exhaust plenums 36, 38 may be arranged in a substantially V-shaped assembly so that after-treatment device 20 has a substantially V-shaped cross-section. Such a V-shaped arrangement may be dictated by an amount of space available in machine 10 for mounting after-treatment device 20. As further illustrated in FIG. 3, first exhaust plenum 36 may have a first outer wall 66 and second exhaust plenum may have a second outer wall 68. First and second outer walls 66, 68 may each be disposed parallel to and spaced apart from outlet 54. An exhaust flow exiting an outlet 54 of a filter assembly 50 may be required to make a sharp turn to enter first or second exhaust plenums 36, 38. To reduce back pressure and to give exhaust exiting outlets 54 a sufficient length to turn and enter first or second exhaust plenums 36, 38, first and second outer walls 66, 68 may be located parallel to and spaced apart from outlets 54 of filter assemblies 50 at a predetermined distance "d." In one exemplary embodiment the predetermined distance "d" may be at least about equal to a diameter of outlet 54.

Returning to FIG. 2, and as discussed above, exhaust flow from center plenum 30 may have to make one or more sharp turns before discharging into the atmosphere. Such an arrangement may result in increased impedance in the form of high back pressure to flow of exhaust through after-treatment device 20. The disclosed after-treatment device 20 may include a number of features to counter the increased back pressure.

For example, center plenum 30 may have a cross-sectional area which varies from first end 40 to second end 42 along a length of center plenum 30. A cross-sectional area of center plenum 30 may be larger adjacent first end 40 relative to a cross-sectional area of center plenum 30 adjacent second end 42. Forcing exhaust to flow through a decreasing cross-sectional area of center plenum may increase the pressure adjacent second end 42 of center plenum 30. The increased pressure adjacent second end 42 may help direct exhaust to enter filter assemblies 50 located adjacent second end 42. Additionally, the increased pressure adjacent second end 42 may force exhaust in center plenum 30 to enter filter assemblies 50 located closer to first end 40.

In another exemplary embodiment, a spacing between filter assemblies 50 may be selected to enable exhaust in center plenum 30 to more easily enter the one or more filter assemblies 50 in first and second filter banks 32, 34. For example, filter assemblies 50 adjacent first end 40 of center plenum 30 may be spaced at a distance "$d_1$," which may be larger than a distance "$d_2$" between filter assemblies 50 adjacent second end 42. Increasing the spacing between filter assemblies 50 adjacent first end 40 may provide exhaust in center plenum 30 a longer distance over which the exhaust can turn, thereby making it easier for the exhaust flows to enter filter assemblies 50 located adjacent first end 40. Further, as described above, second end 42 of center plenum 30 may be closed. As a result, pressure adjacent second end 42 of center plenum 30 may increase as exhaust approaching second end 42 slows down inside center plenum 30. The increased pressure may also help ensure that exhaust in center plenum 30 can turn into filter assemblies 50 spaced closer together adjacent second end 42.

In yet another exemplary embodiment, one or both of the first and second exhaust plenums 36, 38 may have a cross-sectional area that varies along longitudinal axis 46. For example, a cross-sectional area of one or both of first and second exhaust plenums 36, 38 may be smaller adjacent first end 40 and larger adjacent second end 42. Increasing the cross-sectional area of first or second exhaust plenums 36, 38 adjacent second end 42, may help decrease the pressure adjacent second end 42, which in turn may help drive exhaust from center plenum 30 through filter assemblies 50 into first or second exhaust plenums 36, 38.

In yet another exemplary embodiment, back pressure in after-treatment device may be reduced by ensuring that a sum of volumes of first and second exhaust plenums 36, 38 is about equal to a volume of center plenum 30. Doing so may help ensure that an average velocity of exhaust in center plenum 30 is nearly equal to an average velocity of exhaust in first and second exhaust plenums 36, 38, which in turn may help decrease the overall back-pressure in after-treatment device 20. Although various features for reducing back pressure have been discussed individually, one skilled in the art would recognize that one or more of the above-described features may be combined to reduce the overall back pressure and facilitate the flow of exhaust through after-treatment device 20.

INDUSTRIAL APPLICABILITY

The disclosed after-treatment device may be used in any machine or power system application in which exhaust must be cleaned of soot and other harmful gases before being discharged into the atmosphere. Further the disclosed after-treatment device may be used in any machine or power system where the large volume of exhaust generated by the engine makes it is necessary to distribute exhaust to multiple filter assemblies to ensure that the exhaust is adequately cleaned. In addition, the disclosed after-treatment device may be used in any machine or power system where the space available for mounting an after-treatment device is limited.

In the disclosed embodiment, the geometry of the various exhaust passageways and the layout of filter assemblies 50 may be selected help decrease impedance to exhaust flow from engine 18 through after-treatment device 20 to the atmosphere. In particular the location and spacing of filter assemblies 50, cross-sectional areas of center plenum 30 and first and second exhaust plenums 36, 38, and a distance of first and second outer walls 66, 68 from outlets 54 can be selected so as to facilitate the flow of exhaust in after-treatment device 20. Although these techniques may increase pressure locally in certain areas of after-treatment device 20, they may reduce the overall back pressure in after-treatment device 20.

As illustrated in FIG. 2, exhaust in center plenum 30 may have to make sharp 90° turns to enter filter assemblies 50 located adjacent first end 40. Such sharp turns are likely to increase back pressure and impede flow of exhaust through filter assemblies 50. To facilitate the flow of exhaust, filter assemblies 50 adjacent first end 40 of center plenum 30 may be spaced farther apart relative to filter assemblies 50 adjacent second end 42. Increasing the spacing between filter assemblies 50 adjacent first end 40 may provide exhaust in center plenum 30 with a larger length over which exhaust may turn and enter filter assemblies 50 located adjacent first end 40. Such an arrangement would help reduce impedance to the flow of exhaust in after-treatment device 20.

A cross-sectional area of center plenum 30 adjacent its first end 40 may also be made larger relative to a cross-sectional area of center plenum 30 adjacent its second end 42. Reducing the cross-sectional area in this manner may increase pressure adjacent second end 42, which in turn may help divert more of the exhaust into filter assemblies 50 located upstream and adjacent first end 40. In addition, the higher pressure at the inlets 52 of filter assemblies 50 located adjacent second end 42 may help drive exhaust flows through the filter assemblies 50 located downstream or adjacent second end 42.

In addition a cross-sectional area of one of both of first and second exhaust plenums 36, 38 may be smaller adjacent first end 40 and larger adjacent second end 42. Increasing the cross-sectional area of first or second exhaust plenums 36, 38 adjacent second end 42, may help decrease pressure at outlets 54 of filter assemblies 50 located adjacent second end 42. Reducing the pressure near outlets 54 in this manner may help drive exhaust from center plenum 30 through filter assemblies 50 located adjacent second end 42 into first or second exhaust plenums 36, 38.

First and second outer walls 66, 68 of first and second exhaust plenums 36, 38, respectively, may be located at a predetermined distance from an outlet 54 of a filter assembly 50. Locating first and second outer walls 66, 68 further away from outlets 54 may provide a larger distance over which exhaust flows exiting a filter assembly 50 via outlet 54 may be able to turn before flowing through first and second exhaust plenums 36, 38. As is clear from the above description, the features of the disclosed after-treatment device 20 may be used to reduce back pressure without adding additional transition sections or restriction devices, thereby allowing after-treatment device 20 to fit within the space available in machine 10. Additionally, the back-pressure reduction features of after-treatment device 20, described above, can be used with any number of filter assemblies that may be necessary to clean exhaust in modern engine applications.

It will be apparent to those skilled in the art that various modifications and variations can be made to the disclosed after-treatment device without departing from the scope of the disclosure. Other embodiments of the after-treatment device will be apparent to those skilled in the art from consideration of the specification and practice of the after-treatment device disclosed herein. It is intended that the specification and examples be considered as exemplary only, with a true scope of the disclosure being indicated by the following claims and their equivalents.

What is claimed is:

1. An after-treatment device, comprising:

a center plenum configured to be fluidly connected to an engine;

a first filter bank having a plurality of filter assemblies, each filter assembly including:

an inlet fluidly connected to the center plenum, the inlet being oriented orthogonal to the center plenum; and an outlet;

a second filter bank fluidly connected to the center plenum, the second filter bank being oriented orthogonal to the center plenum;

a first exhaust plenum fluidly connected to the outlet, the exhaust plenum being oriented orthogonal to the outlet and having an outer wall disposed parallel to and located at a predetermined distance from the outlet; and a second exhaust plenum fluidly connected to the second filter bank, the second exhaust plenum being oriented orthogonal to the second filter bank, wherein the center plenum, the first and second filter banks, and the first and second exhaust plenums are disposed such that the after-treatment device has a generally V-shaped cross-section.

2. The after-treatment device of claim 1, wherein each filter assembly has a filter axis disposed at an angle ranging from about 45° to 60° relative to a vertical axis of the center plenum.

3. The after-treatment device of claim 2, wherein the predetermined distance is about equal to a diameter of the outlet.

4. The after-treatment device of claim 3, wherein a volume of the center plenum is equal to a sum of volumes of the first and second exhaust plenums.

5. The after-treatment device of claim 4, wherein a spacing between successive pairs of filter assemblies varies along a longitudinal axis of the center plenum.

6. The after-treatment device of claim 5, wherein:

the center plenum has a first end configured to be fluidly connected to the engine and a second end which is closed, and the spacing between successive pairs of filter assemblies is smaller adjacent the first end relative to adjacent the second end.

7. The after-treatment device of claim 6, wherein each of the first and second exhaust plenums has a smaller cross-sectional area adjacent the first end relative to adjacent the second end.

8. The after-treatment device of claim 6, wherein the center plenum has a larger cross-sectional area adjacent the first end relative to adjacent the second end.

9. A machine, comprising:

an engine having a plurality of cylinders;

a center plenum configured to receive exhaust from the plurality of cylinders;

a first filter bank oriented orthogonal to the center plenum and configured to receive a first portion of exhaust from the center plenum;

a second filter bank oriented orthogonal to the center plenum and configured to receive a second portion of exhaust from the center plenum;

a first exhaust plenum oriented orthogonal to the first filter bank and configured to receive the first portion of exhaust from the first filter bank, wherein the first exhaust plenum has a first outer wall disposed parallel to and located at a predetermined distance from an outlet of first filter bank; and a second exhaust plenum oriented orthogonal to the second filter bank and configured to receive the second portion of exhaust from the second filter bank, wherein the second exhaust plenum has a second outer wall disposed parallel to and located at the predetermined distance from an outlet of second filter bank, wherein the center plenum, the first and second filter banks, and the first and second exhaust plenums are arranged to form a substantially V-shaped cross-section.

10. The machine of claim 9, wherein each of the first and second filter banks includes a plurality of filter assemblies, each filter assembly including:

an inlet fluidly connected to the center plenum; and an outlet fluidly connected to one of the first and second exhaust plenums.

11. The machine of claim 10, wherein each filter assembly has a filter axis disposed orthogonal to a longitudinal axis of the center plenum.

12. The machine of claim 11, wherein the filter axis is disposed at an angle ranging from about 45° to 60° relative to a vertical axis of the center plenum.

13. The machine of claim 12, wherein the predetermined distance is about equal to a diameter of the outlet.

14. The machine of claim 13, wherein a volume of the center plenum is equal to a sum of volumes of the first and second exhaust plenums.

15. The machine of claim 14, wherein a spacing between successive pairs of filter assemblies varies along a longitudinal axis of the center plenum.

16. The machine of claim 15, wherein:

the center plenum has a first end configured to receive exhaust from the plurality of cylinders and a second end which is closed, and the spacing between successive pairs of filter assemblies is smaller adjacent the first end relative to adjacent the second end.

17. The machine of claim 16, wherein each of the first and second exhaust plenums has a smaller cross-sectional area adjacent the first end relative to adjacent the second end.

* * * * *